United States Patent [19]

Craft et al.

[11] 4,360,188

[45] Nov. 23, 1982

[54] TENSION BAR FOR CHAIN LINK FENCE

[75] Inventors: Andrew C. Craft, Carmel, Ind.; Robert H. Hill, Chicago, Ill.

[73] Assignee: Delta Cube, Inc., Denver, Ind.

[21] Appl. No.: 185,329

[22] Filed: Sep. 8, 1980

[51] Int. Cl.[3] ..... E04H 17/10

[52] U.S. Cl. ..... 256/47

[58] Field of Search ..... 256/32, 33, 34, 37, 256/40, 47, DIG. 5

[56] References Cited

U.S. PATENT DOCUMENTS

| | | | |
|---|---|---|---|
| 1,985,878 | 1/1935 | Aubol | 256/37 |
| 2,052,774 | 9/1936 | Kundert | 256/32 |
| 2,221,477 | 11/1940 | Gustafson | 256/47 |
| 3,498,588 | 3/1970 | Turner, Jr. | 256/47 |
| 3,993,288 | 11/1976 | Pfarr, Jr. | 256/47 |
| 4,037,788 | 7/1977 | Riley | 256/21 X |
| 4,148,466 | 4/1979 | Wilson | 256/47 |

FOREIGN PATENT DOCUMENTS

| | | | |
|---|---|---|---|
| 907822 | 6/1954 | Fed. Rep. of Germany | 256/21 |

*Primary Examiner*—James Kee Chi

*Attorney, Agent, or Firm*—Woodard, Weikart, Emhardt & Naughton

[57] ABSTRACT

Disclosed is a tubular tension bar adapted for insertion in the vertically aligned terminal links of a conventional chain link fence during installation of the fence. The bar is of oblong, tubular cross-sectional configuration, formed of galvanized steel, sealed at each end, and characterized by its improved strength and shaped to provide a curvature about its major cross-sectional axis to fit closely in the bight of the vertically aligned, U-shaped openings formed by the terminal links of the fence fabric.

3 Claims, 5 Drawing Figures

TENSION BAR FOR CHAIN LINK FENCE

BACKGROUND OF THE INVENTION

Various types of torsion bars are disclosed in U.S. Pat. Nos. 4,148,466; 2,221,477 and 3,993,288. Although the tension bars disclosed in these patents are of various cross-sectional configuration, all are solid throughout their length. Solid tension bars are exclusively used in the installation of chain link fencing throughout the U.S. and these are relatively heavy and expensive to transport while lacking in strength and resistance to bending distortion compared to the shaped, tubular tension bar of the present invention. Less steel is required to fabricate a unit quantity of tension bars of the present invention and the rounded configuration of the margin of the bar engaging the curved portion of the terminal link of the fencing fabric matches the link curvature so that the bar is positioned to receive the tension load along its major axis, the direction of its maximum strength. Cuts and abrasion of the galvanized or plastic coating of the fence links are also eliminated by this positioning of the curved surface of the tension bar.

DESCRIPTION OF THE PREFERRED EMBODIMENT

Figure 1:
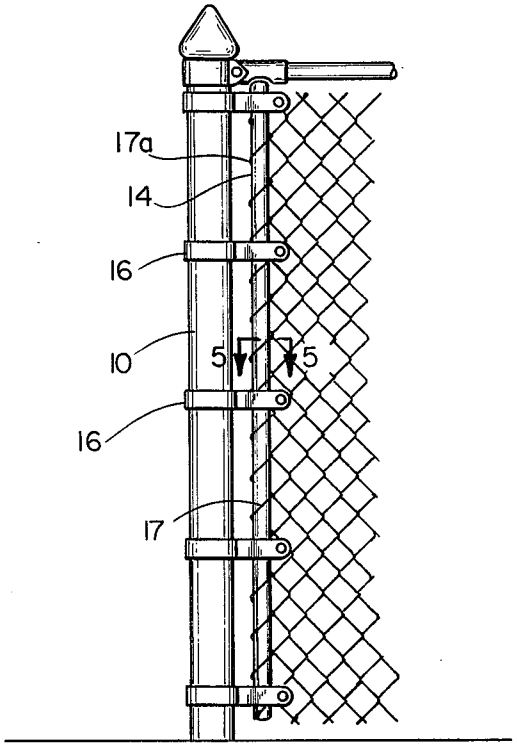
FIG. 1 is a side view of a portion of a typical chain-link fence installation incorporating the tension bar of the present invention.

Referring initially to FIG. 1, there is shown a typical chain-link fence installation comprising a terminal post 10, an upper, atop rigid frame member 12, wire fabric 12, the tension bar 14 of the present invention and band tensioning clamps 16 disposed at spaced intervals along the post 10. The tension bar 14, during erection of the fence, is inserted through the bight of the vertically aligned, U-shaped portions 17*a* of the terminal links 17 of the fence fabric, the position of the tension bar being shown more clearly in FIG. 5.

Figure 2:
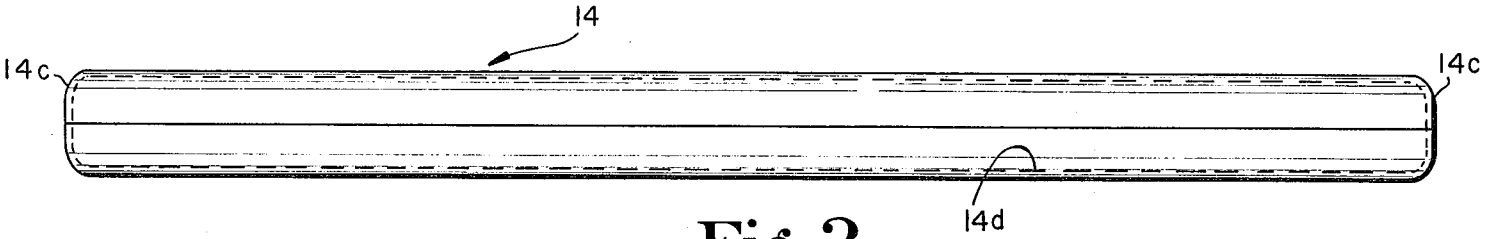
FIG. 2 is a top plan view of the tension bar.
Figure 3:
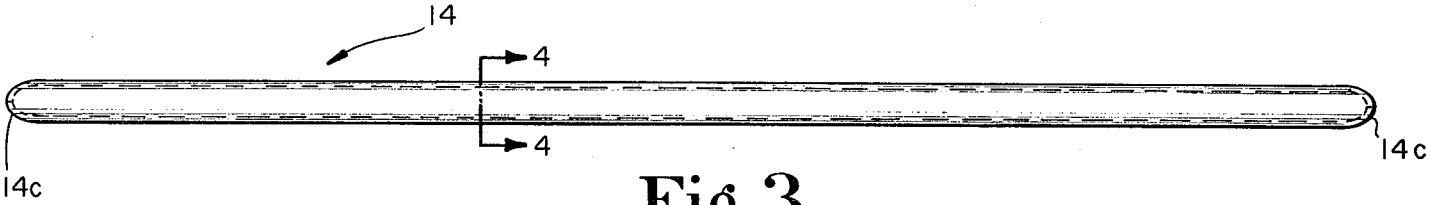
FIG. 3 is a side view of the tension bar.
Figure 4:
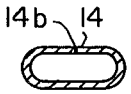
FIG. 4 is a sectional view taken generally along the line 4—4 of FIG. 3.

As shown in FIGS. 2–4, the tension bar 14 is formed of strip steel, preferably of 0.036 gauge, and galvanized or zinc coated on both faces. The strips are mill formed to provide the oblong cross-sectional contour shown in FIG. 4. The seam 14*b* is electro-welded and the ends 14*c* are cut and press formed to provide a curved, marginal contour. The interior face 14*d* and the exterior face of the bar 14 are zinc coated, this together with the sealing of the ends of the bar makes it highly resistant to rust and weathering. The curved margins 14*c* of the bar facilitate its insertion into the aligned openings formed in the bight of the portions 17*a* (FIG 5) of the terminal links 17 of the fence fabric.

Figure 5:
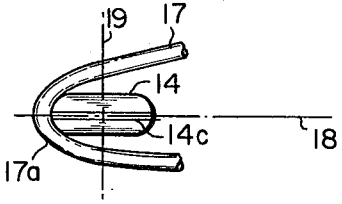
FIG. 5 is an enlarged, fragmentary view, taken in the direction indicated at 5—5 in FIG. 1, showing the relation of a terminal link of the fence and the curved margin of the tension bar.

As will be evident from FIG. 5, the curvature about the major cross-sectional axis of the tension bar substantially matches the curvature of the portion 17*a* of the terminal links 17 of the fence. This assures that the bar is positioned within the terminal links so that the maximum compressive stress, on the bar 14 exerted by the tightened fence, is distributed along the major cross-sectional axis (identified at 18) of the bar, its axis of maximum resistance to bending stress. The curvature of the tension bar substantially matches the curvature of the link portion 17*a* and cuts and abrasion of the fence wire links are minimized.

The preferred transverse thereby proportioning of the bar provides ratio of the major axis (18) to minor axis (identified at 19 in FIG. 5) dimensions of 2.5 A preferred O.D. cross-sectional dimensioning is 0.7 inches on the bar's major axis and 0.280 inches on its minor axis.

The tubular bar of the present invention requires some fifty percent less material than the conventional solid bar. Greater tension resisting strength characterize the bar of the present invention compared to conventional tension bars. The lighter weight of the tubular bar results in substantially lower shipping cost.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An elongated tension bar for insertion in the bight of aligned, generally U-shaped portions of the terminal links of a chain-link fence, said bar being tubular and oblong in cross-sectional configuration and having a curvature about its major cross-sectional axis which substantially matches the curvature at said bight of the terminal links of the fence to provide the maximum distribution of compressive stress along said major axis, said bar being sealed at each end to prevent moisture access to its interior and having its terminal corners rounded to facilitate insertion in said aligned terminal link openings.

2. A tension bar as claimed in claim 1 in which the ratio of the major axis to minor axis dimensions of the oblong tubular bar is approximately 2.5

3. A tension bar as claimed in claim 3 in which said oblong tubular bar has a cross-sectional width of 0.7 inches and a cross-sectional thickness of 0.28 inches.

* * * * *